United States Patent [19]

Uchiyama et al.

[11] Patent Number: 4,662,454

[45] Date of Patent: May 5, 1987

[54] FOAM EXTINGUISHING SYSTEM

[75] Inventors: Jun Uchiyama, Fukaya; Yasuhiro Iwata, Menuma, both of Japan

[73] Assignee: Nohmi Bosai Kogyo Co., Ltd., Tokyo, Japan

[21] Appl. No.: 757,955

[22] Filed: Jul. 23, 1985

[30] Foreign Application Priority Data

Jul. 30, 1984 [JP] Japan ..... 59-157339

[51] Int. Cl.[4] ..... A62C 5/06

[52] U.S. Cl. ..... 169/15; 239/428.5; 239/432; 239/524

[58] Field of Search ..... 169/15, 14; 239/428.5, 239/432, 433, 429, 430, 523–524

[56] References Cited

U.S. PATENT DOCUMENTS

| | | | |
|---|---|---|---|
| 508,130 | 11/1893 | Flanner | 239/432 |
| 3,199,790 | 8/1965 | Giesemann | 239/432 X |
| 3,342,271 | 9/1967 | Anthony, Jr. | 239/432 X |
| 3,368,629 | 2/1968 | Joerren | 169/15 |
| 3,780,812 | 12/1973 | Lambert | 169/15 |
| 4,463,568 | 8/1984 | Willis et al. | 239/432 X |

*Primary Examiner*—Jeffrey V. Nase

*Attorney, Agent, or Firm*—Nies, Webner, Kurz & Bergert

[57] ABSTRACT

A foam extinguishing system in which a foam generating net is provided at the front of a chamber, and foam nozzles and a gas discharge nozzle are provided at the rear of the chamber is disclosed wherein in order to lengthen the flying distance and suspension time of the non-combustible gas solution discharged from the gas discharge nozzle a deflector is provided in front of the nozzle to reflect and disperse a non-combustible gas solution discharged from the nozzle rearwards or sideways from the rear. The gas discharge nozzle provided with the deflector may be also located in such a position that the non-flammable gas solution reflected and dispersed by the deflector does not disturb the discharge pattern of a foam solution from the foam nozzles and that the non-combustible gas is pushed forward by an air flow generated in the air by a negative pressure.

3 Claims, 5 Drawing Figures

FOAM EXTINGUISHING SYSTEM

BACKGROUND OF THE INVENTION

The present invention relates to a foam extinguishing system and more particularly to a foam extinguishing system which generates extinguishing foam containing non-combustible gases such as halogenated gas.

Hitherto known foam extinguishing systems of this kind comprise, as shown in FIG. 1, foam nozzles 3 of aspirator type at the rear part of a chamber 1 provided with a foam generating net 2 at the front, and gas discharge nozzle 7 to discharge non-combustible gas solution which generates halogenated gas, carbon dioxide gas, etc. at the rear of the chamber. Thus a non-combustible gas containing foam is generated by discharging a foam solution and a non-combustible gas solution from the foam nozzles 3 and the gas discharge nozzle 7, respectively.

In such a conventional system a considerable amount of the non-combustible gas solution G′ discharged from the gas discharge nozzle 7 comes into contact and collides with the foam solution F as a liquid prior to its vaporization, resulting in the foam solution which has come into contact and collided with the liquid non-combustible gas is dispersed on the foam generating net 2 in a frozen state. A part of the non-combustible gas which has reached the foam generating net 2 in a liquid state also freezes a part of the foam solution dispersed over the foam generating net 2 in the same way. Consequently the foam generating efficiency is remarkably decreased and simultaneously the content of the non-combustible gas within the generated foam is reduced, resulting in lowering fire extinguishing capability.

It is possible to solve this problem by making the distance between the gas discharge nozzle 7 and the foam generating net 2 sufficiently long enough so that the non-combustible gas solution G′ can be vaporised before it meets the foam solution F. However, this requires that the chamber 1 be remarkably lengthened, and the resultant increase in size of the system poses another problem in connection with its installation. To solve these problems it has been proposed to provide a heater 8, as shown in FIG. 1 with dotted lines, in front of the gas discharge nozzle 7 to heat the non-combustible gas solution G′ discharged from the nozzle 7 and to forcedly vaporize it. However, use of the heater 8 which is liable to malfunction due to shorts in the heating coil necessitates frequent inspection. This also makes the constitution complicated, and therefore it is difficult to equalize the flow of air flow A inside the chamber (this also applies to the case where the heater 8 is arranged at the rear of nozzle 7), making the size of the generated foam uneven. Further new wiring for the heater 8 is needed.

It has also been proposed to provide a spray nozzle 9 at a position shown in FIG. 1 with dotted lines so that a non-combustible gas solution may be discharged in the form of mist. However, in this case such problems arise that the non-combustible gas solution discharged in a mist form is enveloped by the discharged flow of the foam solution F so that the concentration and distribution of the gas becomes uneven, the gas concentration contained in the foam varying greatly, and an optimum discharge pattern of the foam solution F being difficult to obtain because of the disturbance of the dicharge flow of the foam solution F caused by the discharge pressure of the non-combustible gas solution, or the clogging of the spray nozzle. Furthermore, in some cases there still remains a question of freezing of the foam solution.

SUMMARY OF THE INVENTION

It is a principal object of the present invention to provide a foam extinguishing system of the type described above which can eliminate all of the drawbacks inherent in a conventional system of this kind as exemplified above.

It is another object of the present invention to provide a foam extinguishing system of the type described above in which the flying distance and staying time of the non-flammable gas solution discharged from the nozzle can be lengthened without the need for making the chamber larger, or the need for providing a heating means.

It is a further object of the present invention to provide a foam extinguishing system of the type described above which makes it possible to generate a highly expanded foam without impeding the operation of the foam.

It is a still further object of the present invention to provide a foam extinguishing system of the type described above in which the gas discharge nozzle is free from clogging.

A foam extinguishing system in accordance with the present invention attains the above various objects by providing a foam generating net at the front of a square or circular chamber and a gas discharge nozzle at the rear of the chamber and which is characterized in that a deflector is provided at the front of the gas discharge nozzle to disperse the non-combustible gas solution discharged from the discharge orifice of the discharge nozzle sideways from the rear, and that the gas discharge nozzle provided with the deflector is located at such a position that the non-combustible gas solution dispersed by the deflector does not disturb the discharge pattern of the foam solution discharged from the foam nozzles, and that the non-combustible gas solution is pushed forward by an air flow generated in the chamber.

The foam extinguishing system in accordance with the present invention having a constitution with the above characteristics, that is, the gas discharge nozzle provided with a deflector at the front of the discharge orifice being located at the rear portion of the chamber so that a non-combustible gas solution such as a halogenated gas discharged forward from the gas discharge nozzle, i.e. discharged toward the front portion of the chamber, is reflected rearwards and dispersed by the deflector, i.e. sideways from the rear-portion of the chamber, and the non-combustible gas solution which has its velocity energy largely decreased due to the reflection and dispersion, is reversed by the air flow generated in the chamber to be pushed forward. Thus, a sufficiently long flying distance of the non-combustible gas solution and sufficient suspension time in the air flow can be achieved without enlarging the chamber. By this measure it is possible with a simple constitution to vaporize the non-combustible gas solution without providing a heating means so that the non-combustible gas is dispersed and mixed with the air flow, and to generate highly expanded foam containing the necessary quantity of non-combustible gas without impeding foam generation.

BRIEF DESCRIPTION OF THE DRAWINGS

Other objects and advantages of the present invention will become more readily apparent upon reading the following specification and upon reference to the accompanying drawings, in which.

DESCRIPTION OF THE PREFERRED EMBODIMENTS

Now, the embodiments of the foam extinguishing system in accordance with the present invention will be described in reference to FIGS. 2 to 5.

Figure 1:
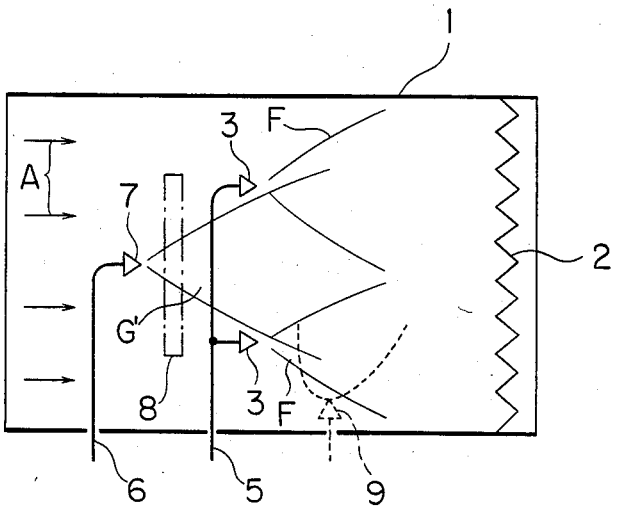
FIG. 1 PRIOR ART
FIG. 1 is a transverse sectional view of a conventional foam extinguishing system.
Figure 2:
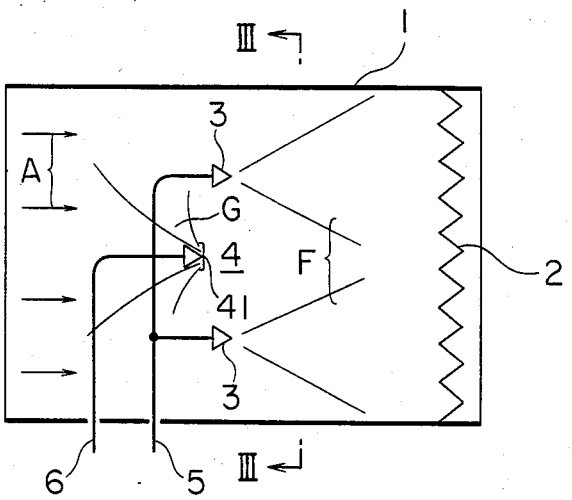
FIG. 2 is a transverse sectional view of one embodiment of the foam extinguishing system in accordance with the present invention.
Figure 3:
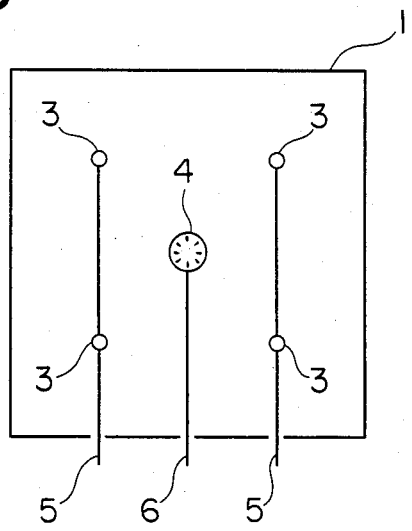
FIG. 3 is a longitudinal sectional view taken along the line III—III in FIG. 2.
Figure 4:
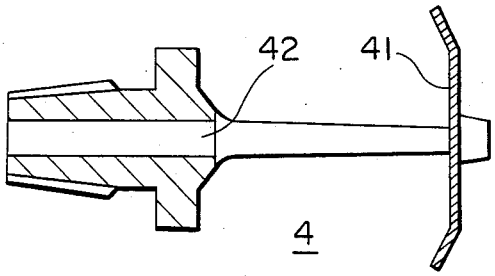
FIG. 4 is a sectional view of one embodiment of the gas discharge nozzle used in the foam extinguishing system in accordance with the present invention.

In FIGS. 2 and 3, 1 is a chamber of square cross section, wherein there is provided a foam generating net 2 at the front of the chamber 1, four aspirator type foam nozzles 3 being provided at the rear of the chamber 1 with their discharge orifices directed towards the foam generating net 2. At a position to the rear of the foam nozzles 3 in the chamber 1 a gas discharge nozzle 4 for discharging a non-combustible gas the cross section of which is shown in FIG. 4, and provided with a deflector 41 at the front of the discharge orifice 42, is located substantially centrally of the four foam nozzles 3. In these FIGS. 5 is a foam solution supply pipe connected via a proportioner not shown to a foam concentrate tank and a water supply source, and 6 is a non-combustible gas solution supply pipe connected to a cylinder of halogenated solution as a non-combustible gas source not shown.

In the foam extinguishing system thus constituted a foam solution is supplied to the foam nozzles 3 under pressure from the supply pipe 5, and a halogenated solution to the gas discharge nozzle 4 under pressure from the supply pipe 6. The supplied foam solution is discharged from the foam nozzles 3 to be evenly dispersed over the foam generating net 2, and air is aspirated from the rear portion of the chamber 1 due to a negative pressure generated by the discharge so that an air flow in the forward direction is generated in the chamber 1 as shown at A in FIG. 2. The halogenated solution is discharged from the discharge orifice 42 of the gas discharge nozzle 4 toward the foam generating net 2, whereby the discharged halogenated solution collides against the deflector 41 provided forward of the discharge orifice 42 so that it is, reflected and dispersed sideways from the rear of the chamber 1 as shown with G in FIG. 2, thus broken into fine particles. The halogenated solution thus reflected and dispersed has its velocity energy remarkably decreased due to the reflection and dispersion by the deflector 41, and is pushed forward, i.e. towards the foam generating net 2 by the air flow A generated in the chamber 1. The halogenated solution which has been reflected and dispersed by the deflector 41 and pushed by the air flow A can travel a long distance and is suspended in the air for an extended time before it meets the foam solution discharged from the foam nozzles 3 shown by F in FIG. 2 after the former has been discharged from the nozzle. Therefore, the halogenated solution vaporizes before it meets the foam solution F and is dispersed in the air flow A in a halogenated gas state. With the air flow containing the halogenated gas, the foam solution dispersed over the foam generating net 2 forms foam containing the halogenated gas in the required amount.

Figure 5:
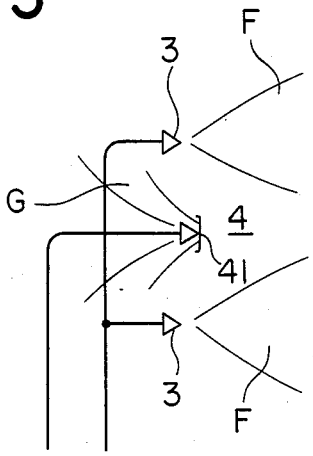
FIG. 5 is a drawing explaining another embodiment of the relationship between the foam nozzle and the gas discharge nozzle.

FIG. 5 shows an embodiment which has a different relationship between the foam nozzles 3 and the gas discharge nozzle 4 with respect to their positions from the above embodiment, and in which a gas discharge nozzle 4 having a deflector 41 to reflect and disperse the halogenated gas solution discharged from the discharge orifice 42 rearwards is located forward of the foam nozzle 3, i.e. at such a position that it is closer to the foam generating net 2 and the halogenated solution reflected and dispersed is not substantially introduced into the discharged foam solution F directly, i.e. a position where it does not disturb the discharge pattern of the foam solution. Also in this embodiment the halogenated solution G discharged from the nozzle 4 and reflected and dispersed rearwards by the deflector 41 is pushed forward by the air flow A, and vaporizes before it meets the foam solution F discharged from the foam nozzles 3, so that it is dispersed and mixed into the air flow A.

From the foregoing it can be said that the gas discharge nozzle 4 should be located at a position where the halogenated solution G reflected and dispersed by the deflector 41 does not disturb the discharge pattern of the foam solution discharged from the foam nozzles 3. As a source of gas to be contained in the generated foam, inert gas such as carbon dioxide may be used besides halon. The deflector for the gas discharge nozzle need not be integrated with the discharge orifice portion of the nozzle.

It is to be understood that although certain forms of the present invention have been illustrated and described it is not to be limited thereto except insofar as such limitations are included in the following claims:

What is claimed is:

1. A foam extinguishing system comprising: a chamber with side walls and having an upstream end and a downstream end for receiving air flow through said chamber, in which a foam generating net is provided at the downstream end of said chamber, and a plurality of aspirator type foam nozzles and a gas discharge nozzle having a discharge orifice are provided at the upstream end of said chamber, said gas discharge nozzle being located on the central longitudinal axis of said chamber, said foam nozzles being evenly spaced around the central longitudinal axis of said chamber in a plane transverse to said central longitudinal axis, a deflector plate being provided immediately downstream of said gas discharge nozzle to reflect and disperse a non-combustible gas solution discharged from the discharge orifice of said discharge nozzle in a direction towards the upstream end or towards the side walls of said chamber, said deflector plate including a main central portion which extends transverse to the central longitudinal axis of said chamber and with said deflector plate having end portions which extend toward the upstream end of the chamber at an angle to said main central portion, said gas discharge nozzle provided with said deflector being located at such a position that there is no wall barrier between said gas discharge nozzle and the side walls of said chamber and further so that said non-combustible gas solution reflected and dispersed by said deflector will not disturb the discharge pattern of a foam solution discharged from said foam nozzles, and that said non-combustible gas will be pushed forward by an air flow generated in said chamber, the stay time and fly distance of said non-combustible gas solution in said air flow being lengthened, resulting in the vaporization of substantially all of said gas solution in said air flow.

2. A foam extinguishing system as claimed in claim 1 wherein said gas discharge nozzle provided with said deflector is located upstream of said foam nozzles with respect to said foam generating net.

3. A foam extinguishing system as claimed in claim 1 wherein said gas discharge nozzle provided with said deflector is located downstream of said foam nozzles with respect to said foam generating net.

* * * * *